US005957185A

United States Patent [19]

Robinson et al.

[11] Patent Number: 5,957,185

[45] **Date of Patent: *Sep. 28, 1999**

[54] DEPLOYABLE AND STACKABLE ACCORDION SHUTTER SYSTEM

[76] Inventors: Jeffry T. Robinson, 15900 Sedgewyck Cir. N., Davie, Fla. 33331; Walter A. Tillit, 921 Falcon Ave., Miami Springs, Fla. 33166

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,231

[22] Filed: Jan. 28, 1997

[51] Int. Cl.[6] ..... E05D 15/00

[52] U.S. Cl. ..... 160/183; 160/199

[58] Field of Search ..... 160/183, 199, 160/206, 235

[56] References Cited

U.S. PATENT DOCUMENTS

| | | | |
|---|---|---|---|
| 2,351,656 | 6/1944 | Auten | 160/199 |
| 5,458,179 | 10/1995 | Magaldi et al. | 160/183 |
| 5,477,903 | 12/1995 | Figueiredo et al. | 160/183 |
| 5,522,445 | 6/1996 | Hoffman | 160/183 |
| 5,601,130 | 2/1997 | Werner | 160/183 |

*Primary Examiner*—Blair M. Johnson
*Attorney, Agent, or Firm*—Patrick C. Barthet, P.A.; Alexander Barthet

[57] ABSTRACT

A novel deployable and stackable accordion shutter system includes an overhead header presenting a track and a laterally disposed abutment surface. The system includes a plurality of trolley supported shutter members which are rotatable about a vertical axis adjacent one edge portion thereof. The system further includes a sill having a guide slot which is disposed beneath the track in alignment therewith. The sill also has an abutment surface disposed in alignment with the abutment surface of the header. The shutter members carry abutment contacting elements disposed for coming into contact with the abutment surfaces to rigidify the structure when the shutter system is deployed. Additional abutment surfaces are provided adjacent the edge of the shutter which is supported by the trolley for further strength. The shutter members are specially configured to facilitate close stacking of the system. In addition, a specially configured washer is provided again for the purpose of facilitating close stacking of the system when it is not deployed.

3 Claims, 9 Drawing Sheets

DEPLOYABLE AND STACKABLE ACCORDION SHUTTER SYSTEM

BACKGROUND OF THE INVENTION

1. Field of the Invention

This invention relates to deployable and stackable storm shutter systems and in particular to such systems which are suitable for resisting high wind loading when deployed and yet occupy a minimum amount of space when retracted and stacked.

2. The Prior Art Background

In areas such as coastal areas, which are regularly subjected to storms generating high winds, it is common to attempt to protect windows and other large expanses of glass by covering the same with shutter systems capable of withstanding large wind loads. In many coastal areas, such as South Florida exacting building codes have been enacted in an effort to regulate the design characteristics of storm shutter systems; however, present day structures are bulky, expensive, difficult to maneuver and often unattractive. Thus, the need for an inexpensive, sturdy, readily deployable, convenient to use, attractive shutter system, which requires a minimum of stacking space, has continued.

Due to recent and significant increases in building code performance standards for hurricane shutters, many designers and manufacturers have made improvements in their designs to bolster the performance of their systems. All of these systems continue to carry forward aspects of original design elements (from the late body of the system (blades) and it's supporting members (tracks). Some designers have developed systems with stronger or larger "pins", others have configured their systems in a way that utilizes more pins per foot of width. Both of these approaches have caused an increase in the "stacking ratio", or bulk of the shutter system, and in the general overall weight (cost) of the system as well.

The modifications described above achieved their original goal of improved performance. However, they have turned consumers off due to their increase in cost and even more so in some cases in their increase in stacking space requirements. This latter issue meets particular market resistance in luxury high-buildings with enormous expanses of glasses, often the occupants "windows to the world". The shutters when applied often stack within the existing glass areas, in effect taking that magnificent and desirable view away. To lessen this is deemed very desirable in this market segment. To couple reduced stacking space requirements with an economical system should result in phenomenal acceptance in the marketplace. Other systems have failed to address the expressed needs/desires of the target market.

A particularly pertinent prior art patent in this area is U.S. Pat. No. 5,097,883, which is directed to an invention that is the joint invention of one of the present inventors. The '883 patent provides valuable information regarding the state of the art, and the entirety of the disclosure thereof is hereby incorporated in this application by reference. However, even with the knowledge provided by the '883 patent, the search has continued for simpler, lighter and stronger systems, which deploy quickly and easily and yet stack away when not needed into the smallest amount of stacking space.

SUMMARY OF THE INVENTION

The shortcomings of prior art storm shutter systems are addressed and alleviated by the present invention which provides a novel deployable and stackable accordion shutter system that is attractive, relatively inexpensive, sturdy, stackable in a small space, readily maneuverable and strong enough to withstand heavy wind loads and otherwise comply with the exacting performance requirements of exacting building and construction codes. In accordance with the invention, the novel deployable and stackable accordion shutter system comprises an elongated header having first and second longitudinally extending, laterally spaced side edges, an elongated track extending along the header adjacent the first side edge thereof and an elongated, outwardly facing abutment structure extending along the header adjacent the second side edge thereof. The abutment surface and the track are spaced laterally apart a predetermined distance.

The system further includes a trolley mechanism mounted on the track for movement in either direction therealong and an elongated, generally rectangularly shaped shutter member. The shutter member has an upper end, a lower end and first and second laterally spaced opposed edge portions. The trolley mechanism is connected to the upper end of the shutter member at a location adjacent the first edge portion thereof such that the shutter member hangs from the trolley mechanism and moves therewith as the trolley mechanism moves along the track. The connection between the trolley mechanism and the shutter member is such that the shutter member is permitted to rotate about a vertical axis which extends through the location where the trolley mechanism and the shutter member are connected. Thus, the axis extends longitudinally of the shutter member.

Also included in the system is an abutment surface contacting element located at the upper end of the shutter member at the second edge portion thereof. The distance between the first and second edge portions of the shutter member being greater than the distance between the abutment surface and the track such that the abutment surface contacting element is positioned outwardly of the abutment surface. The abutment surface contacting element is positioned so that upon deployment of the system the element swings into contact with the abutment surface as the shutter member rotates about its axis.

In one preferred form of the invention, the header includes an inwardly facing abutment surface which extends along the header adjacent the upper end of the shutter member and the first edge portion thereof.

The system of the invention may also include an elongated sill having a longitudinally extending guide slot therein. The slot is disposed beneath the track of the header in vertically spaced relationship thereto and in general alignment therewith. The shutter member extends between the track and the guide slot in the sill. In this aspect of the invention the system also includes a guide pin structure attached to the lower end of the shutter member at its axis of rotation and which extends into the slot.

In a preferred form of the sill, the sill may also include an inwardly facing abutment surface which extends along the sill adjacent the lower end of the shutter member and the first edge portion thereof.

In accordance with the invention the sill may have a longitudinally extending, outwardly facing abutment surface disposed beneath and in general alignment with the abutment surface of the header. The abutment surface of the sill and the slot of the sill are spaced laterally apart approximately the same distance as the track and the abutment surface of the header.

An abutment surface contacting element may be located at the lower end of the shutter member at the second edge portion thereof such that the abutment surface contacting element at the lower end is positioned outwardly of the abutment surface of the sill. Like the abutment surface contacting element at the top of the shutter, the abutment surface contacting element at the lower end of the shutter member is also positioned for contacting the abutment surface of the sill as the shutter member rotates about its axis for deployment.

In another aspect of the invention, the invention provides a shutter system which includes a plurality of elongated generally rectangularly shaped shutter members, each having upper and lower longitudinally spaced opposite ends and first and second laterally spaced edge portions. The shutter members are arranged, when deployed, in a side-by-side, zig-zag array which extends longitudinally of the header. The edge portions of adjacent shutter members are interconnected so as to permit the adjacent shutter members to articulate relative to one another about respective axes which extend vertically along the interconnected edge portions. In this form of the invention, at least one of the shutter members of the array is a trolley supported shutter member. More realistically, in accordance with the preferred aspects of the invention, each of the shutter members of the array is a trolley supported shutter member. Thus, in its preferred form, the deployable and stackable accordion shutter system of the invention includes a plurality of trolley mechanisms.

The shutter system of the invention may also include at least two side-by-side arrays of shutter members which deploy from respective ends of a space to be protected and meet in the center of the space. Each array has a trolley supported centermate structure at the free end thereof and the centermate structures are configured to mate with one another upon closing of the shutter system. Preferably one of the centermate structures includes a male fitting and the other includes a female fitting. The male fitting is received in the female fitting upon closing of the system.

Even more preferably, each of the centermate structures is elongated and coextensive in length with the shutter members, and each includes a generally cylindrical, longitudinally extending slide bolt receiving channel.

In a particularly preferred form of the invention, the various components may be formed by extrusion of a corrosion resistant material such as aluminum.

In another aspect of the invention, the system may comprise a plurality of elongated, generally rectangularly shaped shutter members, each of which has a main central portion and a pair of elongated, laterally spaced edge portions. In this aspect of the invention, the shutter members are arranged for deployment in a side-by-side, elongated, zig-zag array. The edge portions of adjacent shutter members are interconnected so as to permit the adjacent shutter members to articulate relative to one another between deployed and stacked positions about respective axes which extend along the interconnected edge portions. The system includes a projecting pin structure attached at each articulation axis of the shutter members. Each such projecting pin structure comprises a washer which facilitates the articulation of the shutter members. The washers have peripheral edges including a generally convex arcuate edge portion and a generally concave arcuate indentation. The convex edge portions and the concave indentations of adjacent washers are positioned to nest and facilitate close stacking of the shutter members.

In the form of the invention which includes the specially designed washer described above, the washer may include a tab which is disposed within a groove in one of the articulation elements to thereby maintain the positioning of the washer relative to an adjacent washer and facilitate nesting of the corresponding edge portion and indentation.

In another form of the invention, a deployable and stackable accordion shutter system is provided which comprises a plurality of elongated, generally rectangularly shaped shutter members. Each of the shutter members has a main central portion including a major plane and a pair of elongated, laterally spaced edge portions. The shutter members are arranged for deployment in a side-by-side, elongated, zig-zag array, and each shutter member includes an articulation element at each edge portion thereof. The articulation elements of the adjacent shutter members are interconnected so as to permit the adjacent shutter members to articulate relative to one another between deployed and stacked positions about respective axes which extend vertically along the interconnected edge portions. The shutter members each include a laterally extending segment positioned between the main generally planar portion and at least one of the articulation elements such that the articulation element is offset from the major plane to thereby facilitate close stacking of the shutter members.

Simply put, an important feature of the invention lies in the alteration of the top track, and sill (as compared to all previous versions of accordion shutter systems), so as to directly, and continually support the shutter louver panels, thereby relieving or eliminating the stress on extending shutter studs or "pins".

DETAILED DESCRIPTION OF THE PREFERRED EMBODIMENTS

Figure 1:
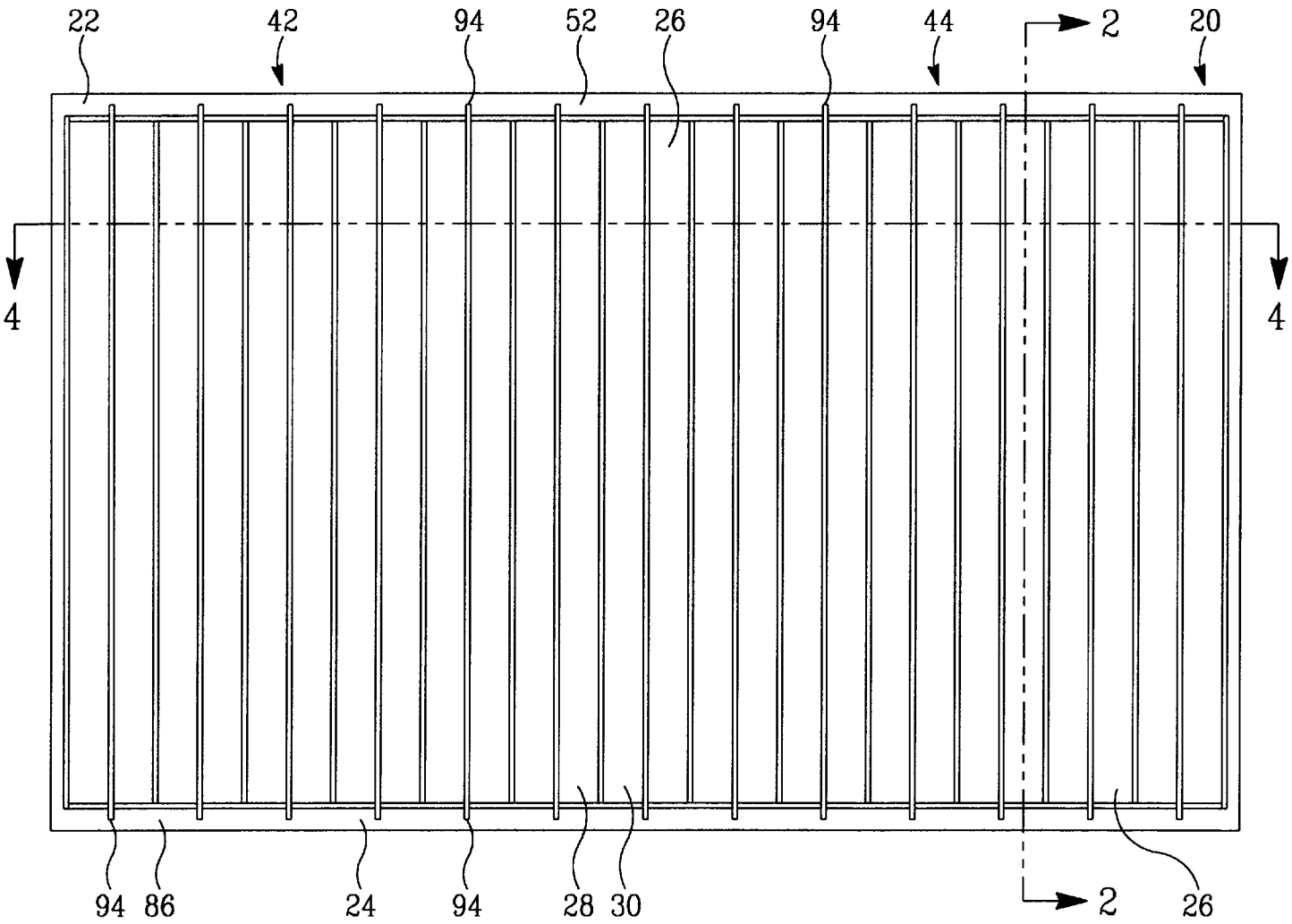
FIG. 1 is an elevational view of a deployed shutter system which embodies the concepts and principles of the present invention.

A deployable and stackable accordion shutter system which embodies the concepts and principles of the present invention is illustrated in FIG. 1, where the system is broadly identified by the reference numeral 20. The system includes an elongated header 22, an elongated sill 24 and a plurality of elongated, generally rectangularly shaped shutter members 26. The system also includes a female centermate structure 28 and a male centermate structure 30, each of which is elongated and coextensive in vertical length with the shutter members 26. The shutter members 26 are supported by trolley mechanisms 32 as can best be seen in FIG. 2.

Each of the shutter members 26 has an upper end 34 and a lower end 36 which are thus spaced longitudinally of the shutter member 26 and at opposite ends thereof.

Figure 2:
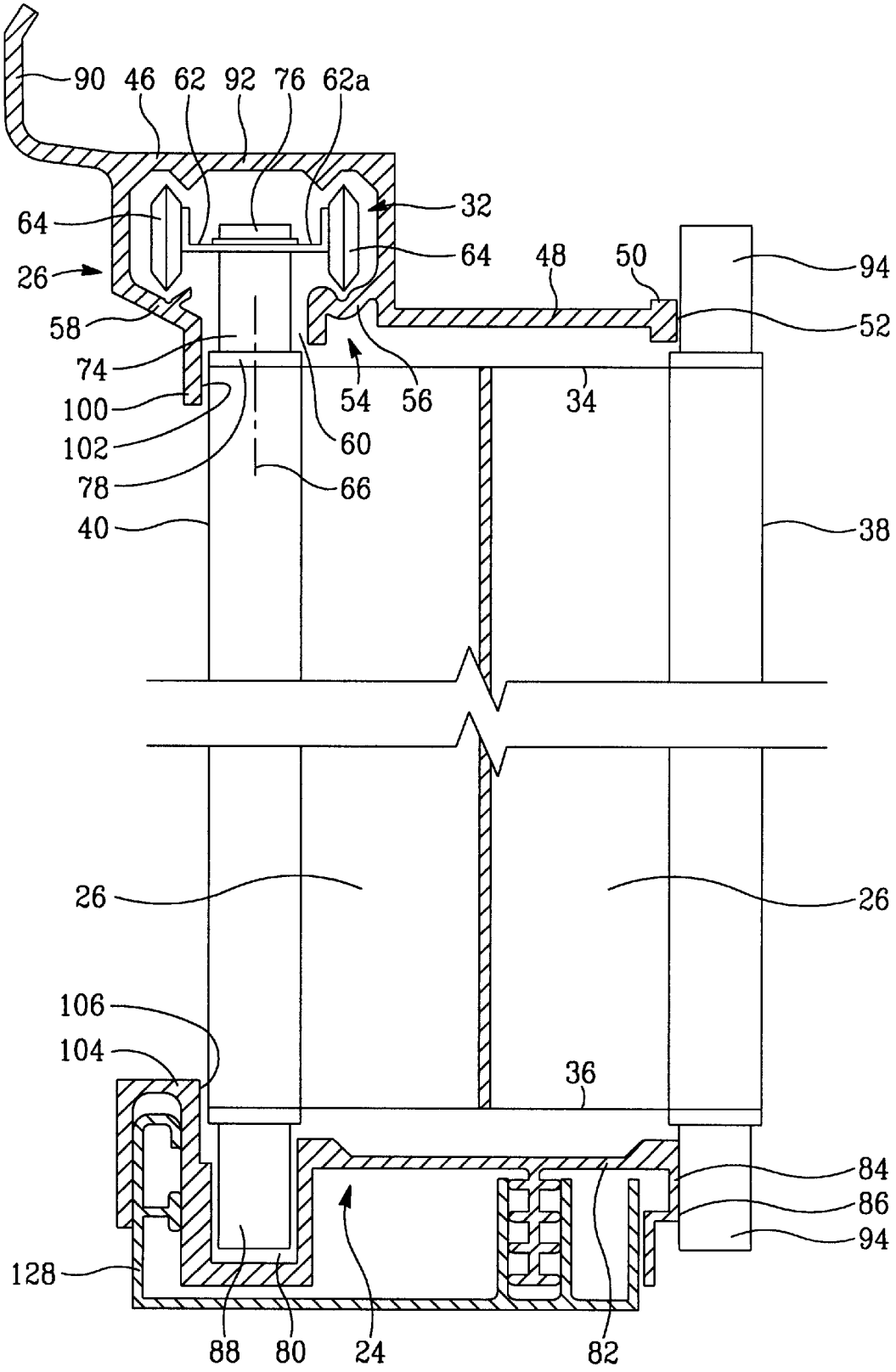
FIG. 2 is an enlarged cross-sectional view taken along the line 2—2 of FIG. 1.

Each shutter member 26 also has a pair of laterally spaced edge portions 38 and 40. These edge portions may best be seen in FIG. 5 which is an end view of a pair of interconnected shutter members 26. In this regard it is to be noted that the left hand edge portion in FIG. 2 is always referred to as edge portion 40, irrespective of whether it is an inner articulation element 68 or an external articulation element 70. Likewise, the right hand edge portions in FIG. 2 are always referred to as edge portion 38 irrespective of configuration. Note that the inner and outer articulation elements 68 and 70 are described in greater detail hereinbelow.

Figure 4:
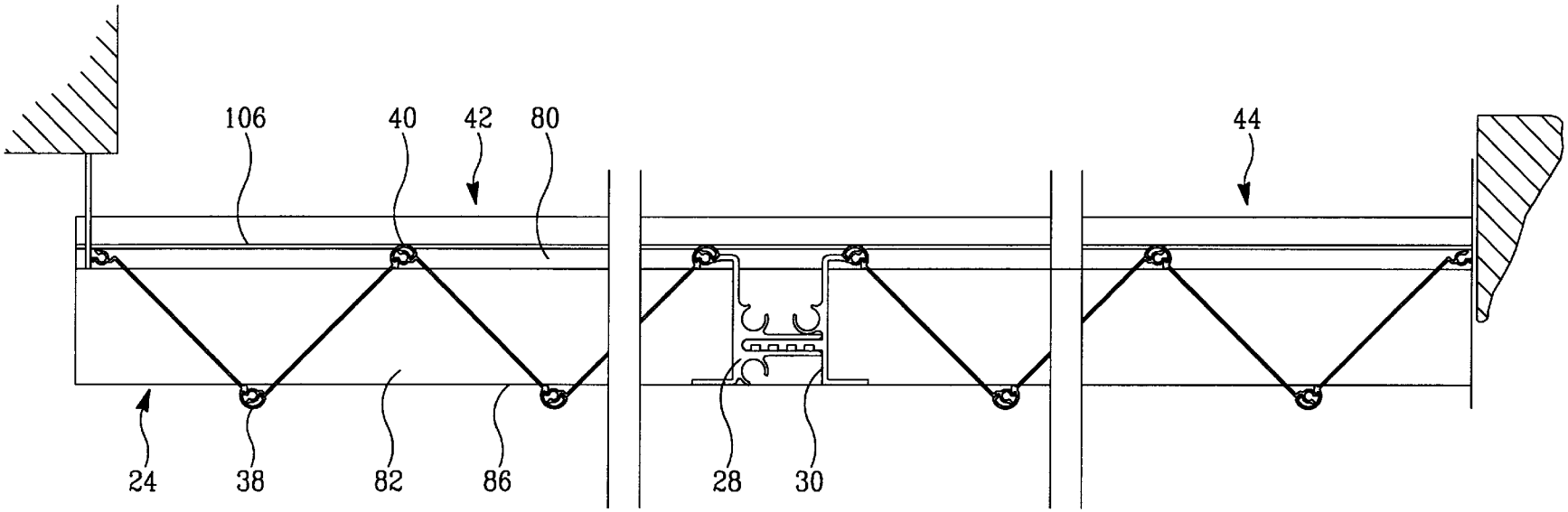
FIG. 4 is an enlarged cross-sectional view taken essentially along the line 4—4 of FIG. 1.

With reference to FIGS. 1 and 4, it can be seen that in the preferred form of the invention, the shutter system 20 includes a pair of arrays 42 and 44 of shutters 26, and when the shutter system is deployed, as is illustrated in FIGS. 1, 2 and 4, the shutter members 26 are arranged in a side-by-side, zig-zag configuration which extends longitudinally of header 22 and sill 24. It can also be seen that each of the arrays 42 and 44 includes at least one trolley supported shutter member 26.

Figure 2A:
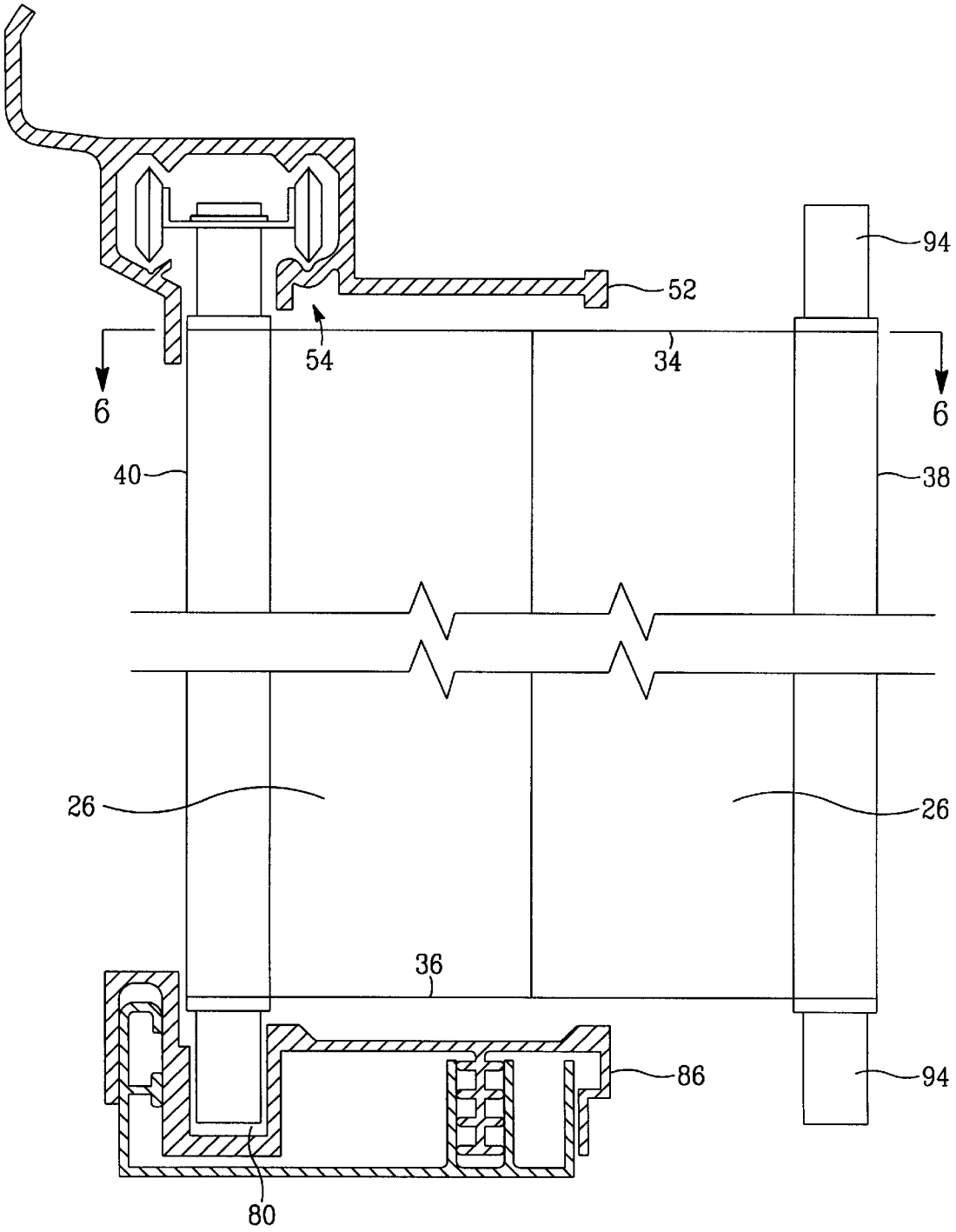
FIG. 2A is an enlarged cross-sectional view similar to FIG. 2 but illustrating the shutter system in its undeployed, stacked position.

The header 22 and the sill 24 are well illustrated in FIG. 2 which shows the shutter system in its deployed position. In this connection it is to be noted that FIG. 2A, which is similar to FIG. 2, illustrates the shutter system in its undeployed, stacked position. Header 22 includes a header box 46 and a laterally extending wing 48. A T-shaped segment 50 at the outboard end of wing 48 presents an outwardly facing abutment surface 52 which extends longitudinally of header 22 for the entire length thereof. Constructed within header box 46 is a track 54 which extends longitudinally of header 22 for its entire length. Track 54 is made up of a pair of spaced portions 56 and 58, and the header is also configured to present a gap 60 which extends the entire length of header 22 between spaced portions 56 and 58 of the track 54 to permit travel of a trolley supported panel.

Again with reference to FIG. 2, it can be seen that the trolley mechanism 32 is disposed within header box 46. Mechanism 32 includes a central C-shaped carriage portion 62 and a pair of wheels 64 which are configured to ride in track portions 56 and 58. Although the wheels 64 are illustrated as being slightly above track portions 56 and 58, in actual operation the wheels 64 will generally be in contact with the track portions 56 and 58 so that the entire trolley mechanism 32 is able to move readily in either direction along track 54. And although a single trolley mechanism 32 is illustrated in FIG. 2, it should be appreciated by those skilled in the art that a trolley mechanism 32 is provided for each interconnected pair of the trolley supported shutter members 26.

Trolley mechanism 32 is connected to the top end 34 of the trolley supported shutter member 26 at a location which is adjacent edge portion 40 of shutter member 26. The connection is such that the trolley supported shutter member 26 hangs from trolley mechanism 32 so as to move therewith as the trolley mechanism 32 moves along track 54. Moreover, the connection between trolley mechanism 32 and shutter member 26 is such that the latter is free to rotate about an axis of rotation 66 which extends downwardly from trolley mechanism 32 and longitudinally of shutter member 26.

To facilitate the rotation of the shutter members 26 relative to the trolley mechanism 32 and relative to one another, each panel 26 has an inner articulation element 68 at one end thereof and an outer articulation element 70 at the other end thereof. These elements 68 and 70 can best be seen in FIGS. 5 and 7. From FIG. 5 in particular, it can be seen that the inner and outer articulation elements 68 and 70 are located at the edge portions 38 and 40 of the shutter members 26.

To facilitate the articulation of the shutter members, each inner articulation element 68 includes a pin receiving channel 72. (See FIG. 7). A pin, which projects downwardly from carriage portion 62, but which cannot be seen in FIG. 2, is received in pin receiving channel 72 and is secured therein by screw threads or the like. The trolley supported pin projects upwardly from the upper end 34 of shutter member 26 and is surrounded by a nylon bushing 74 disposed between the upper end 34 of shutter member 26 and the carriage portion 62 of trolley mechanism 32 as shown. The upper end of the pin projects through carriage portion 62 and is secured by a nut 76 so that the pin and therefore shutter member 26 simply hang from carriage portion 62 and are free to rotate about axis of rotation 66. The structure for supporting shutter member 26 also includes a washer 78 which will be described in greater detail hereinafter.

With reference again to FIG. 2, sill 24 includes a guide slot 80 which extends longitudinally for the entire length of sill 24. Guide slot 80 is disposed beneath track 54 in general alignment therewith. Sill 24 also includes a laterally extending shelf portion 82. A downturned segment 84 at the outboard end of shelf portion 82 presents an outwardly facing abutment surface 86 which extends longitudinally of sill 24 for the entire length thereof.

A guide pin structure 88 is attached to the lower end 36 of shutter member 26 at axis 66 and extends into slot 80 as illustrated in FIG. 2.

The deployable and stackable accordion shutter system 20 may be mounted by bolting an upstanding flange 90 to a vertical wall. Alternatively, the flange 90 may be eliminated and the upper surface 92 of header box 46 may be bolted directly to a horizontal wall. Other mechanisms and appliances for mounting a shutter system are illustrated and described in the '883 patent mentioned above.

When the shutter members 26 are hung from trolley mechanism 32 as illustrated in FIG. 2, the shutter members 26 extend between track 54 and guide slot 80 and are free to rotate about axes 66 which are disposed adjacent the edge portions 40 of the shutter members 26 as the trolley mechanism moves along track 54.

Figure 5:
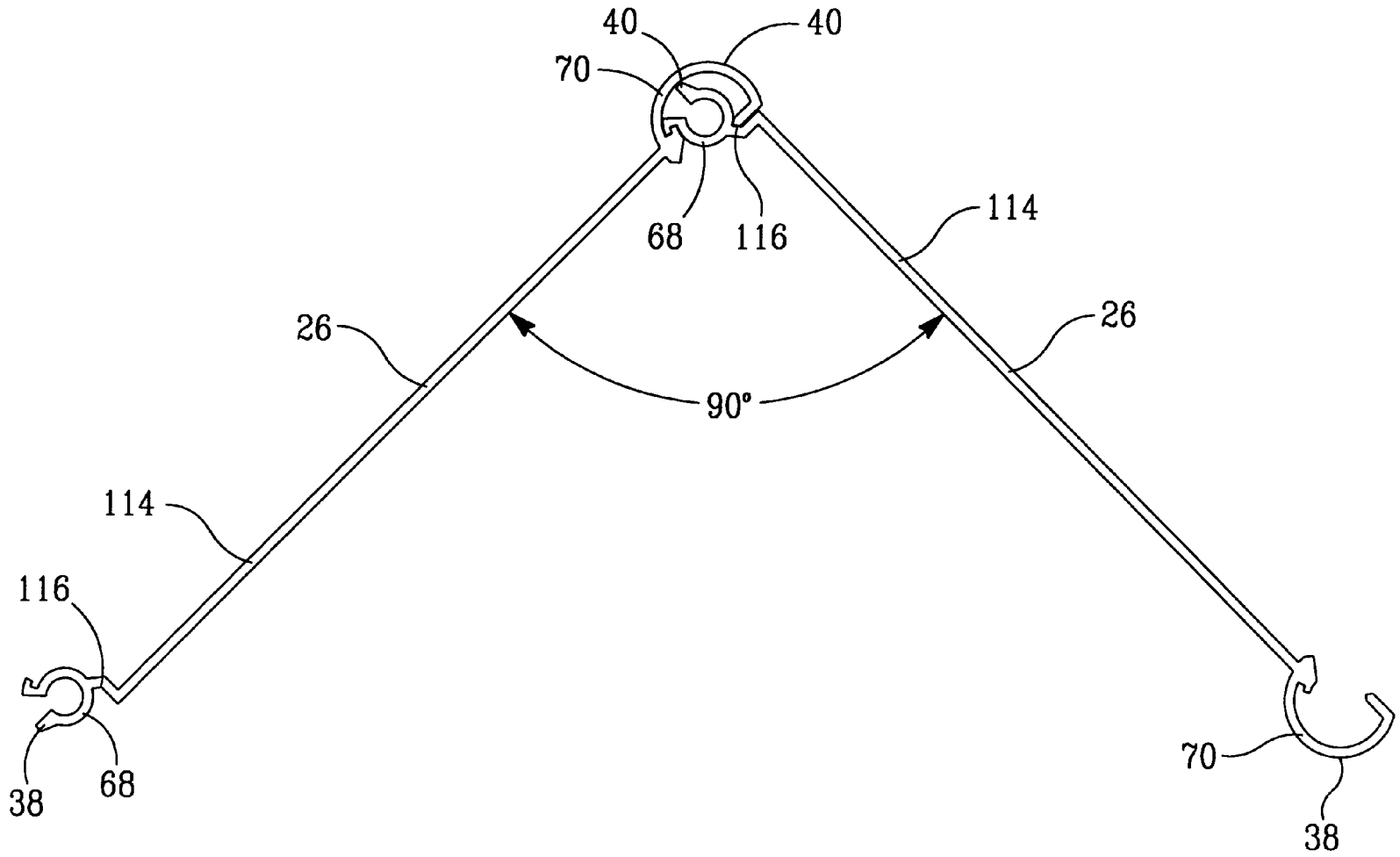
FIG. 5 is an end view of a pair of adjacent shutter members particularly illustrating the articulation interconnection and the degree of articulation permitted by the invention.
Figure 6:
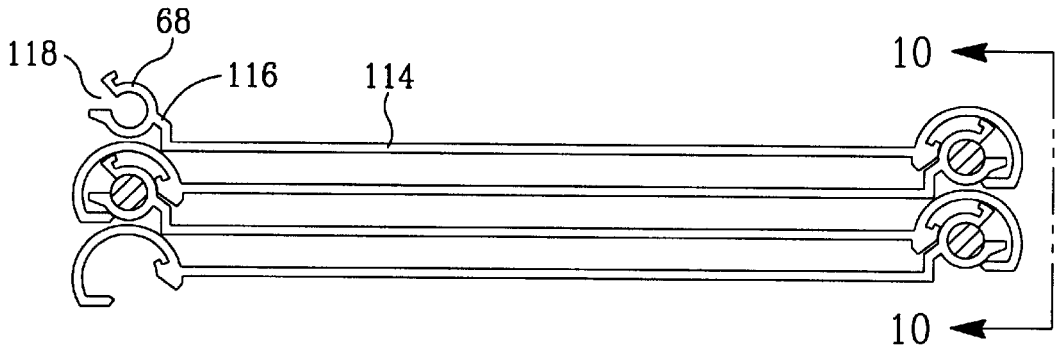
FIG. 6 is an end view of the interconnected shutter members when the same are in their undeployed, stacked condition.
Figure 7:
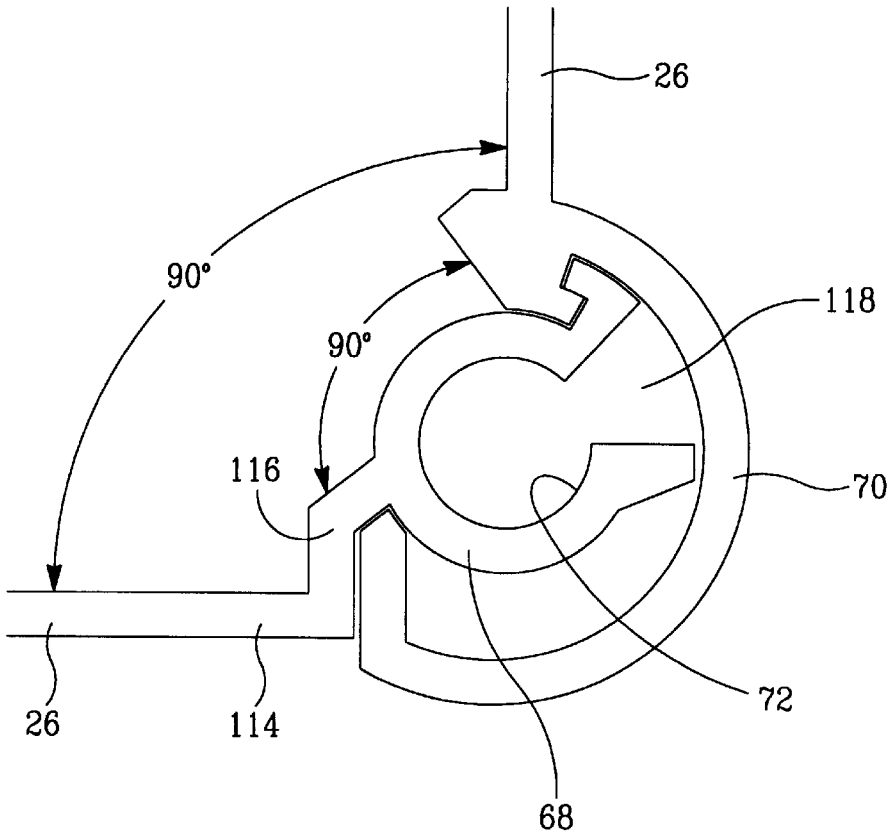
FIG. 7 is an enlarged, fragmentary end view illustrating the interrelationships and operation of the shutter member edge joint portions which permit adjacent shutter members to articulate relative to one another.

The manner in which adjacent shutter members are interconnected is illustrated in FIGS. 5, 6, and 7. In this regard, the adjacent edge portions are interconnected so as to permit adjacent shutter members to articulate relative to one another about axes which extend vertically adjacent edge portions 38 and 40. As can be seen from FIGS. 5, 6, and 7, each inner articulation element 68 includes a pin or screw receiving channel 72. Moreover, each outer articulation element 70 is adapted for receiving an inner articulation element 68 therein as illustrated in FIG. 7. The configuration of articulation elements 68 and 70 and the inner relationships therebetween to facilitate relative articulation of adjacent shutter members is best illustrated in FIGS. 5, 6, and 7, where it can be seen that adjacent shutter members are capable of relative articulation through an angle of about 90°.

Figure 8:
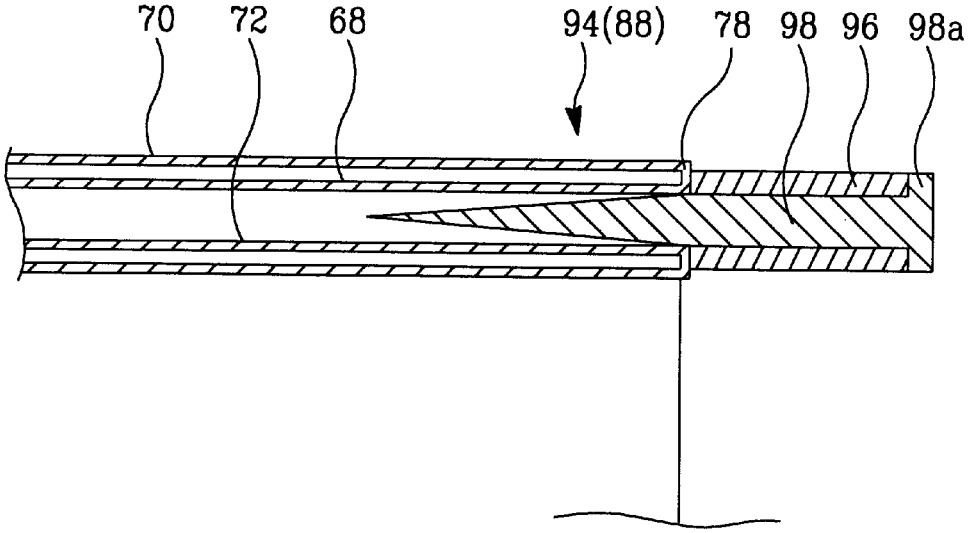
FIG. 8 is a cross-sectional, fragmentary view illustrating the details of the construction of the guide pin and abutment contacting elements.

An abutment surface contacting element 94 is provided at the upper and lower ends of each channel 72 at each outboard interconnection (at the edge portions 38) between adjacent shutter panels. In this regard, each guide pin structure 88 may be of essentially the same construction as the abutment surface contacting elements 94. The details of the elements 94 (and structure 88) are best illustrated in FIG. 8, where it can be seen that the element 94 includes a nylon bushing 96, a washer 78 and a screw 98. The threads of screw 98 bite into the internal surfaces of channel 72 to secure element 94 (or structure 88) in place. The construction of the pin structure for suspending a shutter member 26 from carriage portion 62 may be essentially the same as shown in FIG. 8, except that in that case the web 62A of portion 62 is interposed between the head 98A of the screw and the bushing 96.

Abutment surface 52 is disposed laterally of track 54 and is spaced therefrom a predetermined distance which is less than the horizontal width of the individual shutter members 26. Moreover, the abutment surface 86 on sill 24 is spaced laterally from guide slot 80 approximately the same distance as the distance between abutment surface 52 and track 54. This distance between the abutment surfaces and the track 54 or the guide slot 80, as the case may be, is predetermined so as to provide an angle of about 90° (see FIG. 5) when the shutter system is fully deployed. In this same regard, the edge portions 38 and 40 of shutter members 26 are laterally spaced such that the distance between the edge portions 38, 40 of each shutter member is greater than the distances between the respective abutment surfaces and the track 54 and the guide slot 80. This can be seen in FIG. 2A. This can also be seen in FIG. 9 which provides a schematic view of the shutter system in its stacked or open or undeployed condition.

Thus, when the shutter system is in its stacked condition, the abutment surface contacting elements 94 are located outwardly away from abutment surfaces 52 and 86. On the other hand, after the shutter system has been moved into its deployed condition, as illustrated in FIGS. 2 and 4, the shutter members 26 have rotated relative to the header 22 and sill 24 so that the abutment surface contacting elements 94 have come into contact with corresponding abutment surfaces 52 and 86. It should also be noted that in the illustrated embodiment, the abutment surface contacting elements 94 located at the upper and lower ends of the shutter members 26 are always disposed outwardly of the corresponding respective abutment surfaces so that the abutment surfaces will be contacted by the elements only when the folding shutter system is fully deployed. This contact between the abutment surface contacting elements 94 and the abutment surfaces 52 and 86 provides great strength and wind resistance to the deployed system.

Again, with reference to FIG. 2, the elongated header 22 includes a flange portion 100 which provides an inwardly facing abutment surface 102 that extends along header 22 adjacent the upper end 34 of shutter member 26. Similarly, an upstanding portion 104 on sill 24 provides an inwardly facing abutment surface 106. These abutment surfaces 102 and 106 are in a position to come into contact with the upper and lower ends of the shutter members 26 at edge portions 40 thereof to further support the system and provide even greater strength and wind resistance to the deployed system. Thus, the system provides a unique relationship between an accordion shutter system and its track, sill and shutter elements, where loads or stresses imposed on the shutters may be transferred directly to the track and/or sill without the need for a projecting pin or stud.

With reference to FIG. 4, it can be seen that the array 42 is provided with a trolley supported centermate structure 28 and array 44 is provided with a trolley supported centermate structure 30. For this purpose, each structure 28, 30 is provided with an inner articulation element 68 which interconnects with a corresponding outer articulation element 70 on an adjacent panel member 26. These inner articulation elements 68 each presents a pin or screw receiving channel 72 whereby the centermate structures may be supported by a trolley mechanism in exactly the same way as the shutter members 26.

Each structure 28, 30 also includes a generally cylindrical fitting 108 for accommodating a slide bolt. Slide bolt receiving holes (not shown) may be provided in shelf 82 of sill 24 for receiving the slide bolt to lock the system in either a deployed or undeployed condition.

Figure 3B:
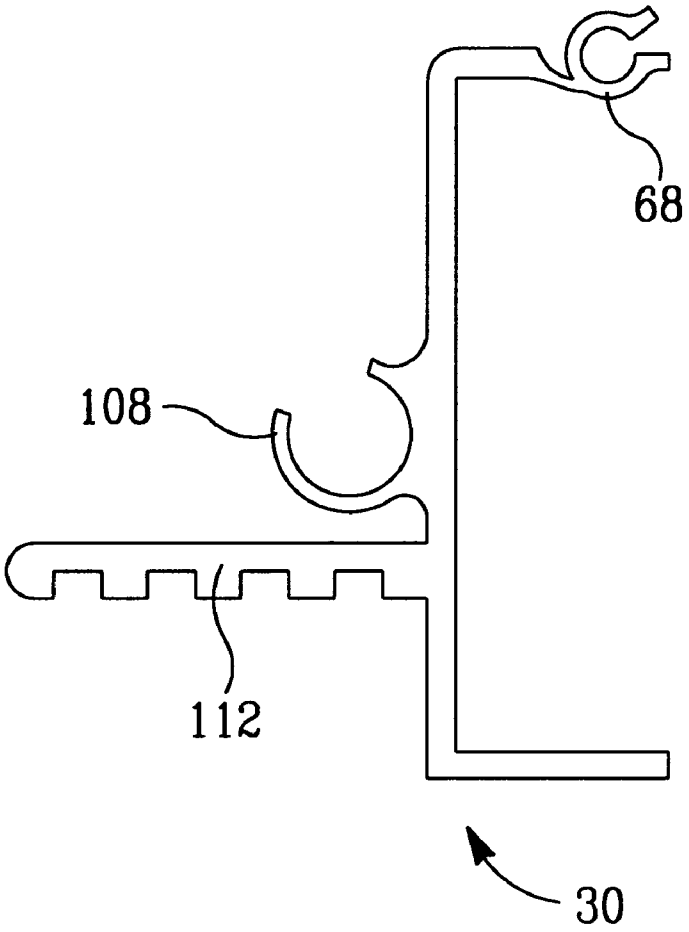
FIG. 3B is an end view of an extruded male center-mate structure used in connection with the system of FIG. 1.
Figure 3A:
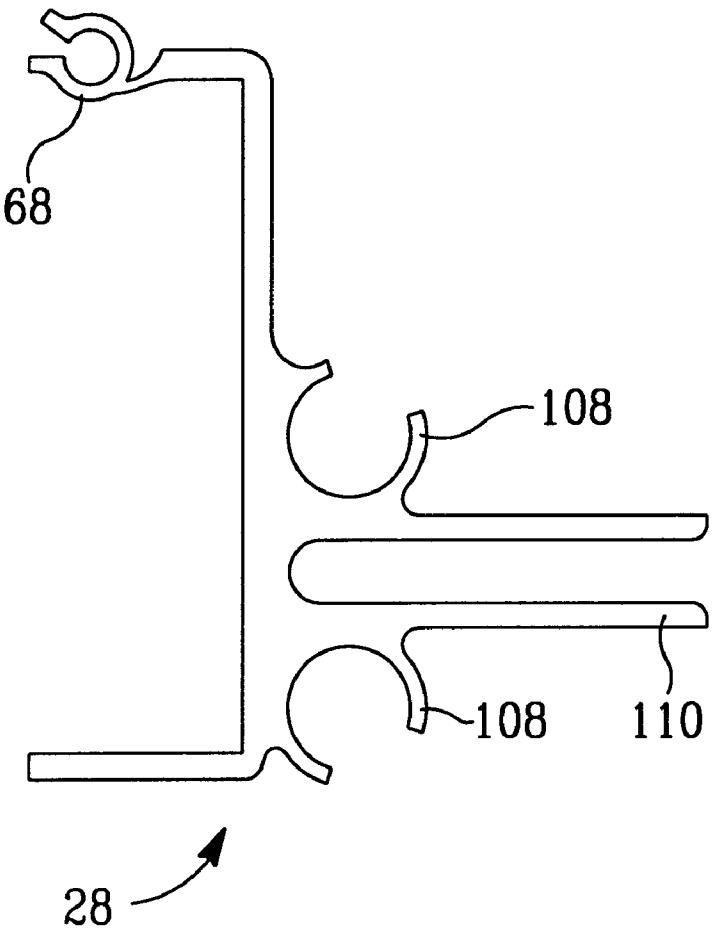
FIG. 3A is an end view of an extruded female center-mate structure used in connection with the system of FIG. 1.

As illustrated in FIGS. 3 and 4, the centermate structure 28 has a female fitting 110 at its right hand side (FIG. 3A), while centermate structure 30 has a male fitting 112 at its left hand side (FIG. 3B). The fittings 110 and 112 mate as the deployable and stackable accordion shutter system 20 becomes fully deployed into its closed condition as illustrated in FIG. 4.

Needless to say, and as fully described in the '883 patent mentioned above, other structures for locking shutter systems are available and well known to those of ordinary skill in the art.

One of the particular advantages of the deployable and stackable accordion shutter system of the invention is its ability to become stacked tightly and compactly in its undeployed, stacked condition. This novel stacked condition available as a result of the present invention is illustrated in FIG. 6. To facilitate this stacking, each of the panel members 26 is provided with a generally planar main central portion 114 and a laterally extending portion 116 which positions the inner articulation element 68 in a location that is offset from the major plane of the central portion 114.

Figure 9:
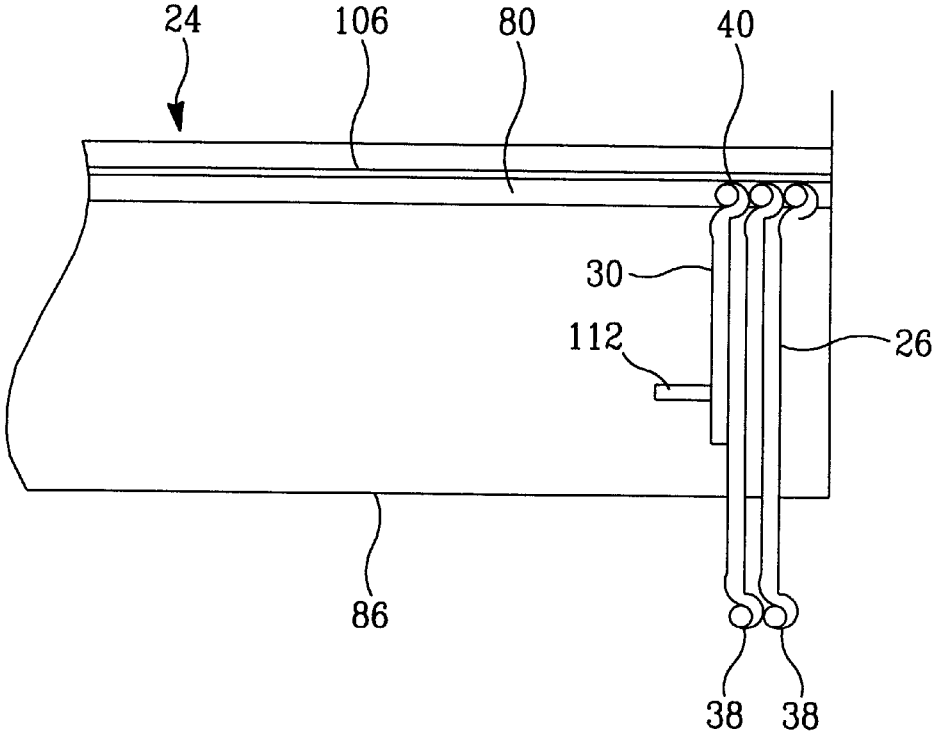
FIG. 9 is a schematic view illustrating one side of the system in an undeployed, stacked condition.
Figure 10:
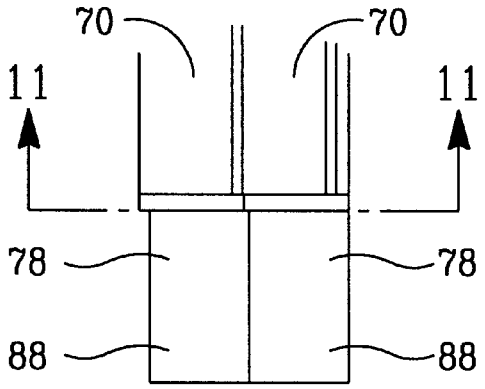
FIG. 10 is an enlarged view taken essentially along the line 10—10 of FIG. 6.
Figure 11:
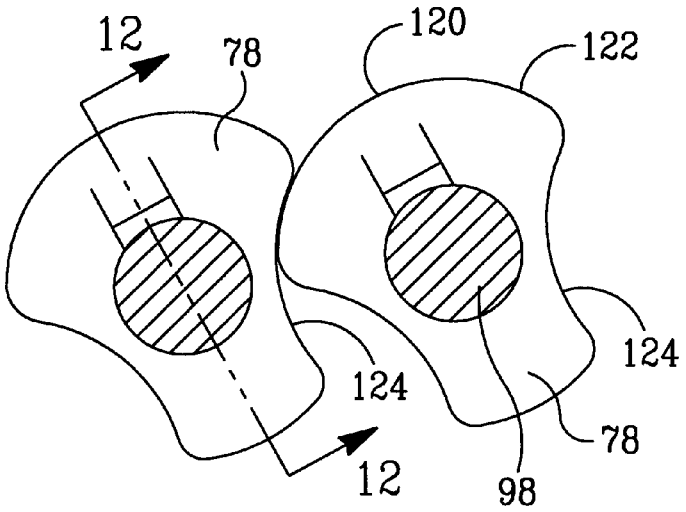
FIG. 11 is an enlarged cross-sectional view taken essentially along the line 11—11 of FIG. 10.
Figure 12:
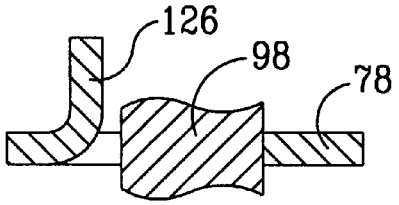
FIG. 12 is a cross-sectional view taken essentially along the line 12—12 of FIG. 11.

Also to facilitate tight stacking of the shutter members, the washers 78 are provided with a special form which works in conjunction with a groove 118 provided in each inner articulation element 68. This special and novel configuration for the washers 78 is illustrated in FIG. 11 where it can be seen that each washer 78 includes an outer peripheral edge 120 which includes a generally convex arcuate edge portion 122 and a generally concave arcuate indentation 124. As can also be seen in FIG. 11, when the shutter panels of the deployable and stackable accordion shutter system of the present invention are in their stacked condition as illustrated in FIGS. 6 and 9, the convex edge portion 122 nests in the generally concave indention 124 of an adjacent washer whereby extremely close stacking of the shutter members is achieved.

Each washer 78 is provided with an upstanding tab 126 which is disposed in groove 118 of the inner articulation element 68 when the various components are assembled. This tab 126 prevents washer 78 from rotating relative to the inner articulation element 68 and keeps the washers in a correct position for nesting when the system is in its stacked condition shown particularly in FIG. 6.

One of the major economical advantages of the deployable and stackable accordion shutter system as described in this application is that most of the components including the header 22, the sill 24, the shutter members 26, the female centermate structure 28, the male centermate structure 30 and most of the mounting hardware have a configuration which permits extrusion, since the cross-sectional configuration of each of these elements is constant from one end to the other. In addition to the foregoing, the vertical height of the system is readily altered simply by changing the length of the shutter members and centermate structures. The horizontal span is readily altered by using more or fewer shutter members and changing the lengths of the header and sill. The vertical height may also be altered by the provision of an adjustable sill adapter such as the adapter 128 illustrated in FIG. 2.

As mentioned above, FIGS. 6 and 9 illustrate the deployable and stackable accordion shutter system 20 in its undeployed, stacked condition. The relative positioning of the inner and outer articulation elements 68 and 70 during such stacking is illustrated particularly in FIG. 6 which also illustrates the manner in which the end fittings snugly nest to minimize the space requirements during stacking. Also as discussed above, the stacking is further facilitated by the provision of the specially shaped washers 78.

The various extrudable components may preferably be formed from an aluminum alloy such as 6005-T5 or 6061-T6 for the shutter members and 6061-T6 for the headers, sills and other extrudable components. For a particularly useful commercial design, the shutter members 26 may preferably be about 5 inches in width between articulation axes and typically may have a thickness of about 0.055". The channels 72 may preferably have an inside diameter of about 0.224" so as to accommodate a ¼" screw thread. The cylindrical fittings 108 may be preferably have an inside diameter sufficient for accommodating a ½" aluminum slide bolt.

The invention provides the first accordion shutter system that utilizes a modification of the supporting horizontal track and sill so as to accept energy or load transfer directly from the shutter louver panels. This differs significantly from the established method of load transfer where the "pins" extend without the benefit of the track support incorporation in the design. By utilizing the continuous support of the horizontal tracks and sills, as opposed to the occasional support of the extending pins, the size and frequency of the pins can be reduced, resulting in smaller compression ratios, or stack space. Also, this enables a substantial reduction in system weight because the louver panels no longer need be designed to transfer load through an intermediate member (the projecting pins), and the resultant system bulk required to allow for large load transfer without failure, or in the gross increase in the number of support pins in order to achieve the same results.

The problem of increased energy or load transfer of accordion shutter systems (generated by recent dramatic increases in building codes as a result of recent land falling hurricanes) has previously been approached by addressing the evident (through testing) weak link in accordion shutter design, specifically extended pin failure (bending/shearing) under very high wind load (uniform load) and under impact (localized loads). Other inventions have beefed up or modified the continuous vertical shutter knuckle, others have added more and stronger extending pins, these solutions have both increased shutter weight (cost) and bulk (stacking ratio). No one has previously attempted to develop a system whereby the energy or load that the wind load or impact forces place upon the shutter louvers or blades directly to the supporting tracks and sills. This system provides for approximately 1/32 inch of separation between the shutter louver panels and the supporting horizontal tracks so as to require some slight lateral wind load or impact load to be present before the shutter panels make direct contact with the supporting tracks. This will allow for smooth and non-binding operation of the shutter panels during normal use. In essence this invention is relatively simple, and completely novel in it's application for this product and use.

Rational analysis supported by recent lab tests show that the expected results have been achieved. Specifically, performance for the most demanding wind areas, with less weight and stacking requirements than any system in it's class. This system of the invention has a distributed blade (louver) weight of 1.552 pounds per square foot with performance ratings (design loads) of approximately 190 pounds per square foot for 8 foot spans. Other systems with the same weight per square foot, only achieve design load ratings of 120 pounds per square foot for the same spans (a 37% reduction). Additionally, systems that meet the same design loads for the same spans have a distributed blade weight exceeding 2.2 pounds per square foot (a 42% increase in weight). Also, the compression ratio for this system is 8/10 inch per foot of extended coverage, compared to a present industry average of 1.35 inches per foot (68% greater bulk), or to industry's best of 1 inch per foot (a 25% increase in bulk).

We claim:

1. A deployable and stackable accordion shutter system comprising a plurality of elongated, generally rectangularly shaped shutter members, each said shutter member having a main central portion and a pair of elongated, laterally spaced edge portions, said shutter members being arranged for deployment in a side-by-side, elongated, zig-zag array, the edge portions of adjacent shutter members being interconnected so as to permit said adjacent shutter members to articulate relative to one another about respective axes which extend along said interconnected edge portions between deployed and stacked positions, said system including a projecting pin structure attached at each said axis of the shutter members, each said projecting pin structure comprising a washer which facilitates said articulation of the shutter members, each said washer having an outer peripheral edge including a generally convex arcuate edge portion and a generally concave arcuate indentation, said edge portion and the indentation of an adjacent washer being positioned to nest and facilitate close stacking of the shutter members.

2. A deployable and stackable accordion shutter system comprising a plurality of elongated, generally rectangularly shaped shutter members, each said shutter member having a main central portion including a major plane and a pair of elongated, laterally spaced edge portions, said shutter members being arranged for deployment in a side-by-side, elongated, zig-zag array, said shutter members each including an articulation element at each edge portion thereof, the articulation elements of adjacent shutter members being interconnected so as to permit said adjacent shutter members to articulate relative to one another about respective axes which extend along said interconnected edge portions between deployed and stacked positions, said shutter members each including a laterally extending segment positioned between the main generally planar portion and at least one of said articulation elements such that the latter is offset from said major plane to thereby facilitate close stacking of the shutter members, said shutter system comprising at least one projecting pin structure attached at each said axis of said shutters each said projecting pin structure comprising a washer which facilitates said articulation of the shutter members, each said washer having an outer peripheral edge including a generally convex arcuate edge portion and a generally concave arcuate indentation, said edge portion and the indentation of an adjacent washer being positioned to nest and facilitate close stacking of the shutter members.

3. A deployable and stackable accordion shutter system as set forth in claim 2, wherein one of the articulation elements of each interconnected pair thereof has a groove extending along the respective articulation axis, said washer including a tab which is disposed within said groove to thereby maintain the positioning of the washer relative to an adjacent washer and facilitate nesting of the corresponding edge portion and indentation.

* * * * *